United States Patent [19]

Suinat et al.

[11] Patent Number: 4,669,345

[45] Date of Patent: Jun. 2, 1987

[54] DEVICE FOR LATERALLY PERFORATING METALLIC PIECES, PARTICULARLY PRESSED PIECES

[75] Inventors: Jean P. Suinat, Soisy/Montmorency; René Suinat, Enghien-Les-Bains, both of, France

[73] Assignee: Suinat, Taverny, France

[21] Appl. No.: 709,707

[22] Filed: Mar. 8, 1985

[30] Foreign Application Priority Data

Mar. 13, 1984 [FR] France ..... 84 03799

[51] Int. Cl.[4] ..... B21D 28/28; B26F 1/02

[52] U.S. Cl. ..... 83/194; 83/182; 83/389; 83/563; 83/627; 83/691

[58] Field of Search ..... 83/54, 414, 524, 525, 83/563, 574, 192–194, 182, 627, 821, 733, 660, 519, 590, 691, 637, 388, 389

[56] References Cited

U.S. PATENT DOCUMENTS

| | | | |
|---|---|---|---|
| 1,398,320 | 11/1921 | Dunsworth . | |
| 2,315,340 | 3/1943 | Knudsen | 164/90 |
| 2,325,437 | 7/1943 | Temple | 83/194 |
| 2,354,860 | 8/1944 | Hartsock et al. | 164/108 |
| 2,539,085 | 1/1951 | Kerseg | 83/627 |
| 2,875,829 | 3/1959 | Patrick | 83/193 |
| 3,477,317 | 11/1969 | Liander | 83/660 |
| 3,485,124 | 12/1969 | Merchant | 83/194 |
| 4,036,091 | 7/1977 | Borzym | 83/519 |

FOREIGN PATENT DOCUMENTS

| | | |
|---|---|---|
| 1048866 | 12/1953 | France . |
| 249422 | 3/1926 | United Kingdom . |
| 1172763 | 12/1969 | United Kingdom . |

*Primary Examiner*—Frank T. Yost
*Assistant Examiner*—Hien H. Phan
*Attorney, Agent, or Firm*—Stevens, Davis, Miller & Mosher

[57] ABSTRACT

The present invention relates to a process and a device for perforating a metallic piece of elongated shape and with straight generatrix, with a view to obtaining, in several successive passes, a pattern which extends over a considerable part of the length of said generatrix and which is constituted by a large number of adjacent perforations in the lateral wall of this piece, said process consisting in repeating at least one elementary pattern which comprises a part of said perforations and which extends over the whole height of the pattern to be made. According to the invention, this elementary pattern is made in one pass, two adjacent elementary patterns being made during different passes. The invention is more particularly applicable to the precision-production of technical and decorative perforations.

2 Claims, 5 Drawing Figures

DEVICE FOR LATERALLY PERFORATING METALLIC PIECES, PARTICULARLY PRESSED PIECES

The present invention relates to a process and to a device for laterally perforating metallic pieces, particularly pressed pieces. Such a process enables pieces to be perforated, particularly for a technical or decorative purpose, and concerns more particularly precision-perforation in which a large number of immediately adjacent perforations are made in a piece by punching. "Immediately adjacent perforations" are understood to mean perforations such that the distance corresponding to their mutually spaced apart relationship is substantially equal to or less than the width of these perforations.

Processes and devices for perforating metallic pieces with a large number of adjacent perforations, in particular for manufacturing filtering boxes or decorative elements, already exist.

French Pat. No. 1 048 866, for example, relates to a process for perforating a cylindrical piece by punching in an elementary pattern which comprises a plurality of perforations spaced apart from one another and extending along a generatrix of the piece; after this pattern has been made, the piece is shifted axially in order to perforate it again in the same pattern, intercalating the perforations made in the second place with those made in the first place; the piece is then slightly rotated to make another series of perforations adjacent the preceding ones, and obtained in the same manner.

According to such a process, it is necessary to make a very large number of passes in order to perforate the piece over the whole of its periphery. In addition, the associated device is complex as it must impart to the piece movements of axial translation and of rotation.

Other processes and devices also exist for making a plurality of spaced apart perforations in a piece. For example, British Pat. No. 1 172 763 discloses perforating a piece, particularly a cylindrical piece, in one pass only and along a plurality of generatrices simultaneously. However, a small number of perforations are made. A similar result is obtained according to the process described in U.S. Pat. No. 2,354,860: pairs of lines of perforations are made which are symmetrical with respect to the axis of the piece, by successive passages in front of a plurality of lines of punches, one pair of lines of perforations being made upon each passage.

According to U.S. Pat. No. 1,398,320, a line of spaced apart perforations is made, upon each pass, along a generatrix of a cylindrical piece, and an elementary rotation of the piece is effected in order to make another line of perforations adjacent the preceding one.

According to British Pat. No. 249 422 and U.S. Pat. No. 2,315,340, a plurality of peripherally spaced apart perforations are made solely in a determined transverse plane of a cylindrical piece.

It therefore appears from all these Patents that only a limited number of perforations can be made in a piece in one pass; moreover, only the French Patent mentioned above relates to adjacent perforations as defined hereinabove, the other Patents all relating to perforations spaced apart from one another.

It is therefore one of the objects of the present invention to provide a process and a device for laterally perforating metallic pieces of elongated shape and with straight generatrix, particularly cylindrical pieces, by means of a large number of conventional punches operating simultaneously.

It is another object of the invention to provide a process for perforating metallic pieces which can be rendered automatic and has a high speed of execution.

These objects, and others which will appear hereinafter, are attained according to the invention by a process for perforating a metallic piece of elongated shape and with straight generatrix, with a view to obtaining, in several successive passes, a pattern which extends over a considerable part of the length of the generatrix and which is constituted by a large number of adjacent perforations in the lateral wall of this piece, said process consisting in repeating at least one elementary pattern which comprises a part of the perforations and which extends over the whole height of the pattern to be made. According to the invention, this elementary pattern is made in one pass, two adjacent elementary patterns being made during different passes.

Pairs of elementary patterns are preferably made at each pass, each constituted by two elementary patterns symmetrical with respect to the axis of the cylindrical piece, and the piece is partially rotated about its axis between two consecutive passes.

The elementary patterns are advantageously imbricated circumferentially.

At least two different elementary patterns are preferably used.

The invention also relates to a device for carrying out this process, which comprises: a vertical press; a plurality of uprights which extend at least over a considerable part of the length of the generatrix of the elongated piece, and which are mounted to slide horizontally on the press bench, along axes converging towards the central axis of the press; means for converting the movement of descent of the mobile part of the press into a simultaneous horizontal displacement of the uprights towards the central axis of the press and to ensure the return of the uprights to their initial position during the rise of the mobile part, these means cooperating with the uprights at least in the axially median zone thereof; a plurality of horizontal punches which are borne by the front face of each upright facing the centre of the press and which are disposed substantially one below the other over the whole height of the upright, these punches being adapted to penetrate in openings of corresponding section made in a stake fixed vertically at the centre of the bench, this stake having a diameter corresponding to the inner diameter of the cylindrical piece to be perforated and being covered by this piece.

Each upright is preferably provided on its front face with a stop with horizontal slide, compression springs being interposed between the stop and the upright, the punches passing through the stop and coming level with its front face when the mobile part of the press is in high position, and this stop being progressively applied against the stake when the mobile part descends.

The means for simultaneously manoeuvring the uprights advantageously comprise an arm which is rigidly suspended from the mobile part of the press, which cooperates with a recess made in a shoulder of the uprights lying in the axially median zone thereof, and which presents a part in ramp form, the recess presenting a corresponding ramp form, the ramp-shaped part of the arm being extended by a vertical part which cooperates with a recess made in the press bench.

The invention will be more readily understood on reading the following description with reference to the accompanying drawings, in which:

FIG. 1 shows a partial plan view of a pattern to be made according to the process of the invention.

FIG. 2 schematically shows a plan view of the piece to be perforated, and the different phases of the process according to the invention.

Figure 1:
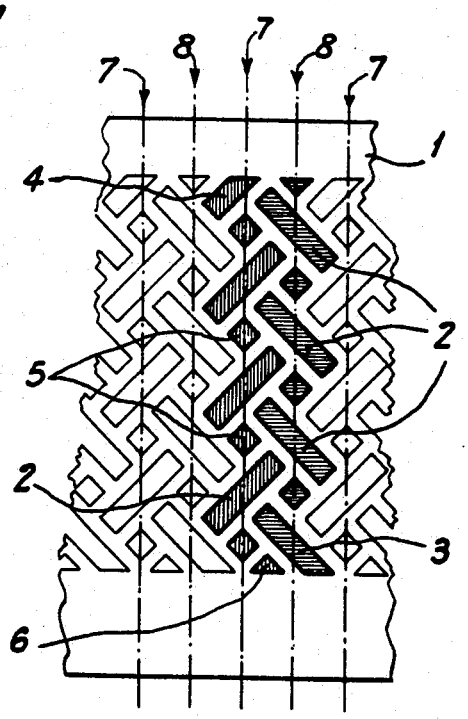

Referring now to the drawings, FIG. 1 shows the developed side wall 1 of a cylindrical metallic piece of elongated form to be perforated in a pattern extending over a considerable part of the length of the generatrix of this piece and over the whole periphery of this piece. This pattern is constituted by the juxtaposition of a large number of small surfaces of which the shape is chosen from: a large rectangle 2, a large bevelled rectangle 3, a small bevelled rectangle 4, a small square 5 or a small triangle 6. The process according to the invention consists in perforating the wall 1 of the cylindrical piece along each of these surfaces.

In order to be able to carry out this process to the best advantage, it is necessary to design the pattern itself, which is a decorative pattern in the present case, in a certain manner. In the present case of a cylindrical piece, the pattern is obtained by alternately repeating two juxtaposed elementary patterns 7, 8 which extend mainly along two respective generatrices of the cylindrical piece and over the whole height of the pattern to be made.

Each elementary pattern 7, 8 is mainly constituted by an alternance of rectangles 2 and of squares 5 disposed one beneath the other along these generatrices. The two elementary patterns 7, 8 are disposed in one spaced apart relationship, over the whole periphery of the cylindrical piece and are each repeated eight times, in accordance with this embodiment, each being made in one pass. Sixteen perforations are therefore made in the cylindrical piece. It will be noted that the two patterns 7, 8 are imbricated circumferentially.

Figure 2:
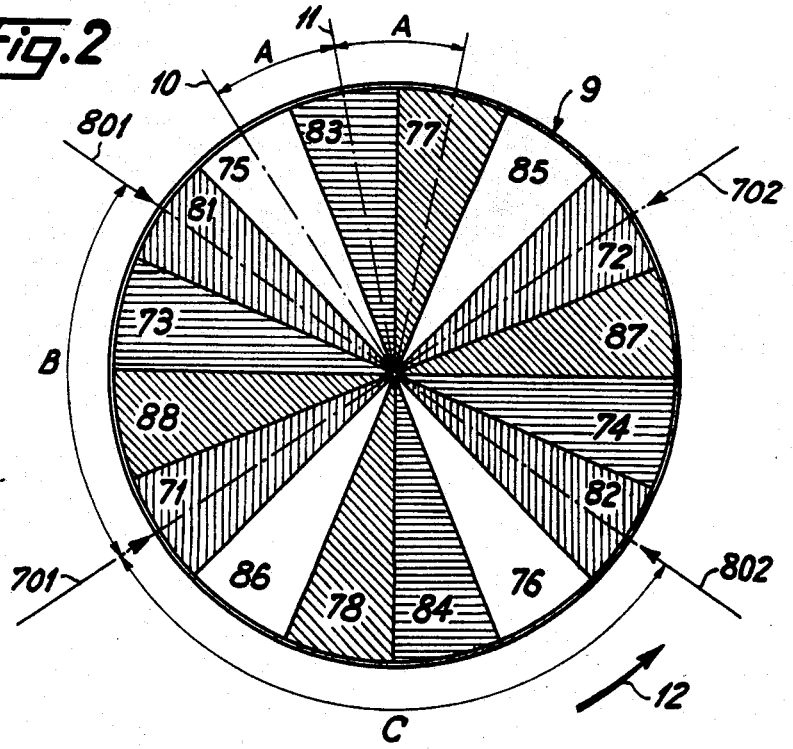

FIG. 2 shows the sixteen angular portions corresponding to the perforations to be made. Eight angular portions 71 to 78 are relative to the elementary pattern 7, and eight portions 81 to 88 alternating with the preceding ones are relative to the elementary pattern 8. For example, the angular portion 85 subtends the portion of cylinder 9 along which the pattern 8 extends. For greater clarity, the imbrication of the perforations has not been shown, therefore nor that of the different angular portions which present in principle zones of mutual overlapping. The angle between the median planes 10, 11 of two adjacent angular portions always has the same value A.

It will now be explained in which order are effected the sixteen perforations numbered by their corresponding angular portions 71 to 78 and 81 to 88. Said perforations are made in four successive passes: four perforations are simultaneously made during each pass, and two adjacent perforations such as (85, 72) or (81, 75) are always made during different passes. FIG. 2 distinctly shows the four groups of perforations (71, 72, 81, 82), (73, 74, 83, 84), (75, 76, 85, 86), (77, 78, 87, 88) corresponding to the four successive passes.

To make these perforations, the cylindrical piece is perforated in the direction of the four arrows 701, 702, 801, 802 upon each pass, the perforations along arrows 701, 702 reproducing elementary pattern 7 and those in the direction of arrows 801, 802 the elementary pattern 8. These four arrows are in line with the median plane of four angular portions 71, 72 and 81, 82 symmetrical in two's with respect to the axis of the cylindrical piece. Furthermore, the angle B between the arrows 701 and 801, or 702 and 802, is equal to three times the angle A. This results in that the angle C between arrows 701 and 802, or 702 and 801, is equal to 5 times angle A.

The first pass therefore allows the simultaneous execution of the four perforations 71, 72, 81, 82 of which the angular portions are disposed opposite arrows 701, 702, 801, 802. The cylindrical piece is then rotated about its axis in the direction of arrow 12, by an angular value equal to twice the angle A. This has for an effect to dispose the angular portions (73, 74, 83, 84) respectively in front of arrows (701, 702, 801, 802) and to made the corresponding perforations. A further rotation of the cylindrical piece by the same value enables perforations (75, 76, 85, 86) to be made in the same manner.

Finally, a last rotation enables perforations (77, 78, 87, 88) to be made. In accordance with the desired objective, it may be noted that the elementary patterns 7, 8 are alternate, and that two adjacent perforations are effected during different passes.

Figure 3:
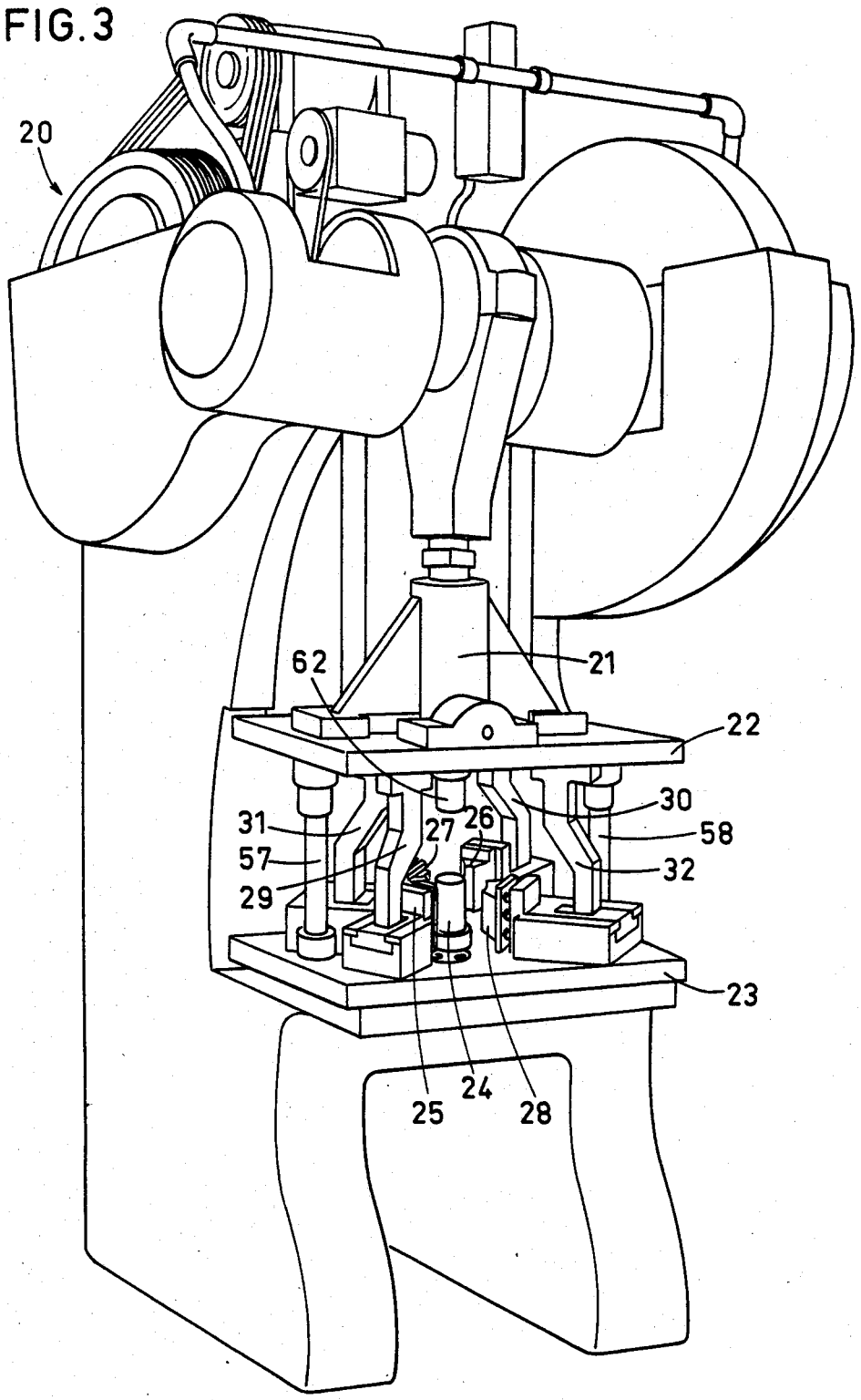
FIG. 3 is a view in perspective of a press for carrying out the process according to the invention.

FIG. 3 shows a device for carrying out the process described hereinabove for the perforation of cylindrical pieces. It comprises a vertical press 20 of which the slide 21, provided with a sole plate 22, cooperates with a press bench 23. The cylindrical piece to be perforated is mounted vertically at the centre of the press bench 23, on a stake 24. Four uprights 25 to 28 provided with punches are mounted for horizontal slide on the press bench 23 about the stake 24. They are set into motion by four arms 29 to 32 suspended from the sole plate 22 of the press slide 21 when the latter moves vertically.

Figure 4:
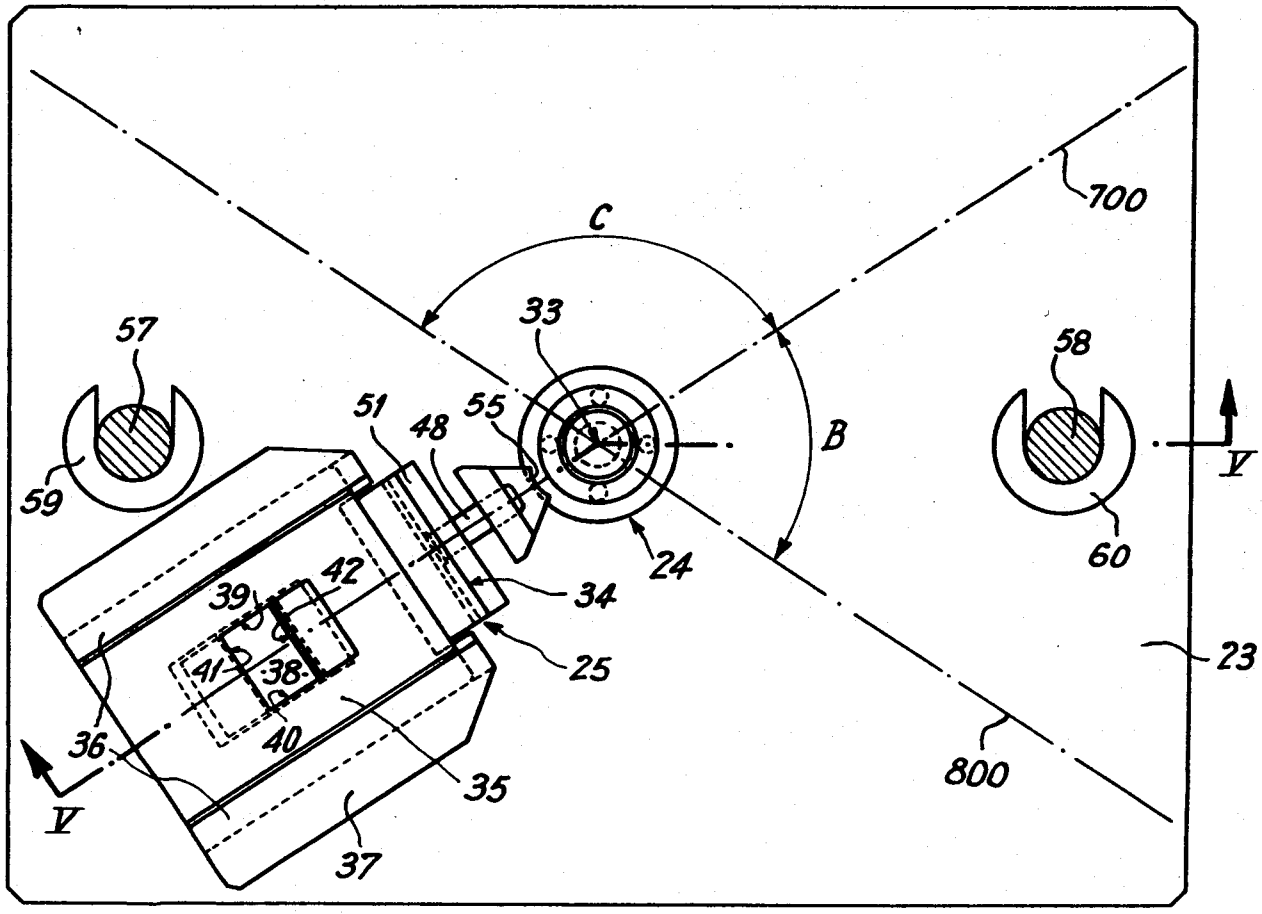
FIG. 4 is a plan view of the press bench equipped with the perforating punches.
Figure 5:
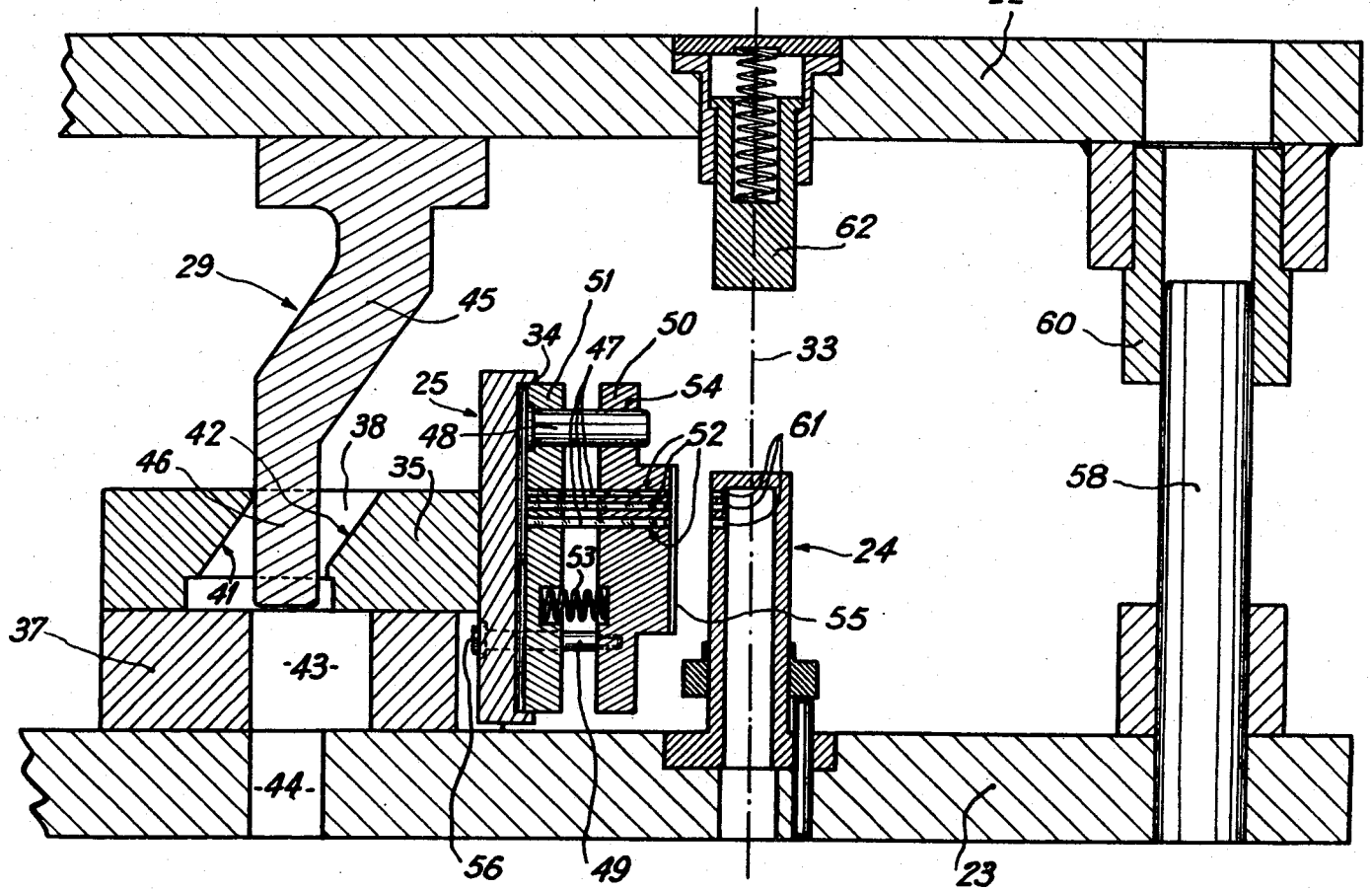
FIG. 5 is a view in section along line V—V of FIG. 4.

FIGS. 4 and 5 show the device of the invention in detail. The four uprights 25 to 28 are mounted for horizontal slide on the press bench 23, along two horizontal axes 700, 800 passing through the central vertical axis 33 of the press. The two axes 700, 800 are shifted by an angle B and by a complementary angle C defined in relation with FIG. 2. The four uprights 25 to 28, their guide means and the arms 29 to 32 are identical. Only the characteristics relative to upright 25 are therefore shown in FIGS. 4 and 5 and described.

The height of upright 25 is greater than that of the cylindrical piece to be perforated. Its front face 34 is oriented towards the central axis 33 of the press and bears a plurality of punches 47—of which only a few have been shown in FIG. 5—extending horizontally towards the axis 33 of the press and disposed beneath one another, in immediately adjacent manner, over the whole height of the pattern to be made. The front face 34 of upright 25 also bears horizontal spindles 48 enabling a stop 50 disposed in front of the front face 34 to slide. The spindles 48 and the punches 47 are applied on the upright 25 by a sole plate 51. The stop 50 possesses through channels 52 for the passage of the punches 47, and through channels 54 for the passage of the spindles 48. Compression springs 53 are disposed between the upright base plate 51 and the stop 50. Spindles 49 limit the slide of the stop 50 in the direction of the force exerted by the springs 53; they pass through the upright 25 and its sole plate 51 and screw in the stop 50. Spindles 49 present a terminal shoulder 56 which abuts against the upright 25 at the end of forward stroke of the stop 50. The front face 55 of the stop 50 presents a curvature corresponding to that of the stake 24. At the end of forward stroke of the stop 50, the punches 47 come level with its front face 55 by their free end.

The means for displacing and guiding the upright 25 will now be explained. Upright 25 is provided with a parallelepipedic rear shoulder 35. The latter extends perpendicularly to upright 25, from the axially median zone of the upright. A parallelepipedic guide 37 is interposed between the shoulder 35 of upright 25 and the press bench 23. Its height is such that upright 25 does not rest on the press bench 23 but is slightly distant therefrom.

The shoulder 35 of upright 25 has two ribs 36 projecting laterally and sliding in corresponding grooves in the guide 37. It is provided with a recess 38 passing therethrough between its two horizontal faces. This recess 38 possesses two vertical side walls 39, 40 and two front walls 41, 42 in the form of a ramp inclined towards the press bench 23 and radially outwardly with respect to the axis 33 of the press. The guide 37 and the press bench 23 each have a vertical recess 43, 44 disposed plumb with the recess 38. The sole plate 22 of the press slide rigidly bears the suspended arm 29. The latter has a ramp-shaped part 45 complementary of the recess 38 of the shoulder 35. The ramp-shaped part 45 is extended by a vertical part 46 which, in section, has dimensions very slightly smaller than those of the recess 44 of the press bench 23.

During operation and upon descent of the sole plate 22 of the press slide, the arm 29 passes through the shoulder 35 of upright 25, the guide 37 and the press bench 23, at the level of their respective recesses. The ramp-shaped part 45 of arm 29, by cooperating with recess 38 of the shoulder 35, provokes displacement of the upright 25 towards the stake 24. At the same time, the vertical part 46 of the arm 29 is housed in the recess 44 of the press bench: arm 29 is thus rigidly maintained by its end. It follows that this arm may transmit to upright 25 a considerable force, and may oppose the effort of reaction generated by punching, without bending. Thanks to this arrangement, the number of punches 47, per upright, may be large, without there being any need to give prohibitive dimensions to arm 29 and consequently the whole of the device. The median position of the shoulder 35 on upright 25 ensures good distribution of the force on this upright.

From the moment when the stop 50 is applied against the stake 24, the punches 47 penetrate into the latter, perforating the piece which covers it.

The sole plate of the press slide 22 is positioned in its vertical movement with respect to the press bench 23 by two alignment spindles 57, 58 fast with the press bench 23, and sliding in sleeves 59, 60 fast with the sole plate 22 of the press slide.

The stake 24 is generally cylindrical in form, corresponding to the shape of the piece to be perforated, which will cover the stake 24. This stake 24 generally has the same shape as the piece to be perforated. It is fixed at the centre of the press table 23, and is located opposite the front face 55 of the stop 50. The stake 24 is hollow and in addition possesses openings 61 in its lateral wall, whose section corresponds to that of the punches 47, these openings 61 lying exactly opposite the punches 47. A device for automatically evacuating the chips is advantageously connected to the interior of the stake 24. On the sole plate 22 and opposite the stake 24 there is suspended a finger 62 which firmly presses the cylindrical piece to be perforated on the stake, in low position of the sole plate 22, to ensure precise positioning of the piece.

To carry out the process according to the invention with the aid of the device described hereinabove and to obtain the pattern shown in FIG. 1, the uprights 25, 26 lying on axis 700 are equipped with an assembly of punches for making the elementary pattern 7, and columns 27, 28 lying on axis 800 are provided with punches for making the elementary pattern 8. A non-perforated cylindrical piece is mounted on the stake 24 corresponding to the preceding punches. A descending movement of the sole plate 22 provokes a strictly simultaneous displacement of the four uprights 25 to 28 towards the stake 24. The first group of perforations (71, 72, 81, 82) is thus made. Whilst the sole plate 22 is being raised, the springs 53 move the four uprights 25 to 28 away from the stake 24. The cylindrical piece is then rotated manually or mechanically through an angle equal to twice the angle A and in the direction of arrow 12 of FIG. 2. A second descending movement of the sole plate 22 will enable the second group of perforations (73, 74, 83, 84) to be made. After execution of the four successive passes, the perforated cylindrical piece is withdrawn from the stake and replaced by a non-perforated piece.

By causing opposite pairs of groups of punches to operate simultaneously, the device described hereinabove makes it possible precisely to balance the efforts applied on the piece to be perforated and on the stake, and in particular to avoid any rotation of the piece during perforation. This also results in a high speed of execution, since four groups of punches or even more operate together on the periphery of the piece. The groups of punches may of course also be moved by an assembly of perfectly synchronized jacks. The elastic return stop is applied against the piece and firmly maintains those parts of the piece having to be stressed by the punches. Each punch may advantageously be provided with a detector for detecting any break. The different detectors are controlled by a data-processing system which indicates any breakdown at any instant and which localizes it.

The process of imbrication of a plurality of elementary patterns advantageously enables the same zone of the piece to be perforated in several steps, so as to stress the wall of the piece as little as possible. In the case of extremely dense perforations, it is hardly possible to envisage a process in one pass. Furthermore, the decomposition of the wall of the piece into a large number of portions (71 to 78 and 81 to 88) makes it possible to effect a perforation virtually perpendicularly to this wall; the perforations thus have edges perpendicular to this wall. According to the invention, not only pressed pieces but also extruded pieces may be perforated.

What is claimed is:

1. A device for perforating a hollow cylindrically metallic piece of elongated shape and with straight generatrix, in at least one pattern which extends over a considerable part of the length of said generatrix and which is constituted by a large number of adjacent perforations, comprising:

a vertical press composed of a stationary press bench and a vertically movable part;

a plurality of uprights which extend at least over a considerable part of the length of the generatrix of the elongated piece, and which are mounted to slide horizontally on the press bench, along axes converging towards the central axis of the press;

means for converting the vertical descent of the movable part of the press from an uppermost position to a lowermost position into a simultaneous horizontal displacement of the uprights towards the central axis of the press to a forward position and to ensure the return of the uprights to a backward initial position during the rise of the movable part, these means cooperating with the uprights at least in an axially median zone thereof, each said upright having a shoulder defining a recess therein, said recess having parallel slanted portions, said press bench having reoesses therein and the means for converting the vertical descent of the movable part of the press into simultaneous horizontal displacement of the uprights comprising a plurality of arms, rigidly suspended from the movable part of the press, each said arm having parallel slanted sections which cooperate in vertical movement with said parallel slanted portions of said recess in said shoulder of the upright lying in the axially median zone thereof, said parallel slanted sections of the arm being extended by a vertical part which cooperates with a recess of said press bench and corresponding in dimensions, so that said arm is maintained rigidly during punching and immobilizes the upright in the forward position when said movable part is in the lowermost position and immobilizes the upright in the backward position when said movable part is in the uppermost position;

a hollow cylindrical stake positioned on the press bench extending coaxially with the central axis of the press, said stake having openings therein; and a plurality of horizontal punches which are borne by the front face of each upright facing the center of the press and which are disposed substantially one below the other in adjacent manner over the whole height of the pattern to be made, these punches being adapted to penetrate corresponding openings in said stake, said stake having a diameter corresponding to the inner diameter of the cylindrical piece to be perforated and supporting said piece.

2. The device of claim 1, wherein each upright is provided on its front face with a stop with horizontal slide, compression springs being interposed between the stop and the upright, the punches passing through the stop and coming level with its front face when the mobile part of the press is in high position, and this stop being progressively applied against the stake when the mobile part descends.

* * * * *